US006234082B1

(12) United States Patent
Cros et al.

(10) Patent No.: US 6,234,082 B1
(45) Date of Patent: May 22, 2001

(54) LARGE-CALIBER LONG-RANGE FIELD ARTILLERY PROJECTILE

(75) Inventors: Anne-Laure Cros, Bourges; Gérard Lamorlette, Trezelles, both of (FR)

(73) Assignee: Giat Industries (FR)

( * ) Notice: Subject to any disclaimer, the term of this patent is extended or adjusted under 35 U.S.C. 154(b) by 0 days.

(21) Appl. No.: 09/158,550

(22) Filed: Sep. 22, 1998

(30) Foreign Application Priority Data

Sep. 24, 1997 (FR) ..... 97 11835

(51) Int. Cl.[7] ..... F42B 13/16
(52) U.S. Cl. ..... 102/520
(58) Field of Search ..... 102/520, 521, 102/522, 523; 244/3.27, 3.28, 3.29

(56) References Cited

U.S. PATENT DOCUMENTS

| | | | | |
|---|---|---|---|---|
| H905 | * | 4/1991 | Rottenberg | 244/3.28 |
| 2,941,470 | * | 6/1960 | Jasse | 244/3.23 |
| 3,620,167 | * | 11/1971 | Romer et al. | 102/521 |
| 3,834,314 | * | 9/1974 | Young | 102/521 |
| 3,845,922 | * | 11/1974 | Mayer | 244/3.28 |
| 3,905,299 | * | 9/1975 | Feldmann | 102/522 |
| 3,961,580 | * | 6/1976 | Burnett et al. | 102/520 |
| 4,209,146 | * | 6/1980 | Mattson | 244/3.27 |
| 4,332,360 | * | 6/1982 | Topliffe | 244/3.27 |
| 4,430,943 | * | 2/1984 | Bock et al. | 102/522 |
| 4,534,294 | * | 8/1985 | Von Laar et al. | 102/520 |
| 4,653,404 | | 3/1987 | Halverson . | |
| 4,756,255 | * | 7/1988 | Rosenberg et al. | 102/521 |
| 4,776,280 | * | 10/1988 | Burri et al. | 102/523 |
| 4,833,995 | * | 5/1989 | Gotz et al. | 102/521 |
| 4,944,226 | * | 7/1990 | Wedertz et al. | 102/476 |
| 5,020,436 | * | 6/1991 | Coburn | 102/377 |
| 5,164,540 | * | 11/1992 | Chiarelli et al. | 102/526 |
| 5,182,419 | * | 1/1993 | Burnette | 102/523 |
| 5,196,650 | * | 3/1993 | Cytron | 102/521 |

FOREIGN PATENT DOCUMENTS

| | | |
|---|---|---|
| 3243430 | 5/1984 | (DE) . |
| 3730359 | 1/1992 | (DE) . |
| 2008535 | 1/1970 | (FR) . |
| 2098933 | 2/1972 | (FR) . |
| 1516073 | 6/1978 | (GB) . |
| 81/00908 | 4/1981 | (WO) . |

* cited by examiner

*Primary Examiner*—Thomas Price
(74) *Attorney, Agent, or Firm*—Parkhurst & Wendel, LLP

(57) ABSTRACT

An artillery projectile to be fired from a large-caliber gun barrel. The projectile comprises a body whose rear part is fitted with deployable stabilizing fins, wherein the body is sub-calibered and carries at least one ejectable guiding sabot fitted with a sliding drive band to reduce the spin rate of the projectile.

9 Claims, 5 Drawing Sheets

LARGE-CALIBER LONG-RANGE FIELD ARTILLERY PROJECTILE

BACKGROUND OF THE INVENTION

The technical scope of the invention is that of projectiles, in particular large-calibre long-range field artillery projectiles.

An increase in the range of artillery projectiles has long been sought after. Thus, a base-bleed has been installed to the tail end of ballistic trajectory projectiles which is designed to reduce the drag of the base by means of the emission of gases developed by the combustion of a composition such as propellant. The base-bleed only increases the range of the projectiles by around 5 to 10% and generates dispersions, which prejudice firing accuracy.

A further proposition to increase firing accuracy has been made consisting in effecting a correction of the trajectory or by terminal guidance. But as ballistic trajectory projectiles are spin-stabilised, it is very difficult to carry out accurate trajectory correction or terminal guidance. Moreover, only accuracy is improved, the range remaining relatively short.

Patent WO100908 proposes an artillery projectile fitted with a base-bleed having a drive band, piloting ailerons and stabilising fins. This projectile is fin-stabilised over part of its trajectory during which the base-bleed is operational, and then the base-bleed is ejected, which enables the deployment of the stabilising fins, which brake the rotation of the projectile. The projectile is thus on a trajectory stabilised by its fin tailpiece. Thereafter, terminal guidance can be carried out by means of the piloting ailerons.

Such a concept has several drawbacks. Firstly, the passage from a spin-stabilised trajectory to a fin-stabilised trajectory generates numerous constraints. In fact, the fin tailpiece is subjected to strong mechanical stresses during its deployment, which can generate a loss in the stability of the projectile and/or considerable dispersion. Furthermore, as explained previously, the range of such a projectile is relatively short.

SUMMARY OF THE INVENTION

The aim of the invention is to propose a projectile, which is simple, inexpensive, and has a considerable firing range.

Thus, the subject of the invention is an artillery projectile, designed to be fired from a large-calibre gun barrel, which comprises a body whose rear part is fitted with deployable stabilising fins, wherein the body is sub-calibred and carries at least one ejectable guiding sabot fitted with a sliding drive band intended to reduce the spin rate of the projectile.

According to a particular embodiment the guiding sabot is positioned at a rear part of the projectile body whilst holding the deployable stabilising fins in place, their deployment being carried out when the rear sabot is ejected upon exiting the barrel.

It advantageously comprises a second guiding sabot positioned at a front part of the projectile and ejectable upon exiting the barrel.

The front sabot is formed of at least two segments connected to the body by a temporary connecting means formed of at least one shearable pin, whose shearing is caused by the relative recoil of the sabot with respect to the body of the projectile during the longitudinal acceleration of the projectile in the gun barrel.

The front sabot advantageously possesses an inner profile which matches an external profile of the front part of the projectile and there is an axial clearance between the inner profile of the sabot and the external profile of the front of the projectile so as to allow the relative recoil of the sabot with respect to the projectile body during its longitudinal acceleration in the gun barrel.

According to one embodiment, the projectile incorporates in its front part deployable piloting ailerons.

The rear sabot advantageously comprises a thrusting part which receives the sliding drive band and a tubular part covering the rear part of the projectile body whilst keeping the stabilising fins in their folded-back position.

According to a particular embodiment, the projectile comprises a rear booster.

According to a first variant embodiment, the rear sabot is ejected upon exiting the gun barrel by means of the pressure generated by the booster.

According to a second variant embodiment, the rear sabot is ejected by means of a pyrotechnic charge placed between the thrusting part of the rear sabot and the rear part of the projectile body.

The tubular part of the rear sabot is preferentially provided with longitudinal zones of embrittlement, which are intended to break during the ejection of the sabot so as to increase its aerodynamic drag.

BRIEF DESCRIPTION OF THE DRAWINGS

The invention will be better understood after reading the description of a particular embodiment, description made with reference to the appended drawings in which.

DETAILED DESCRIPTION OF PREFERRED EMBODIMENTS

Figure 1:
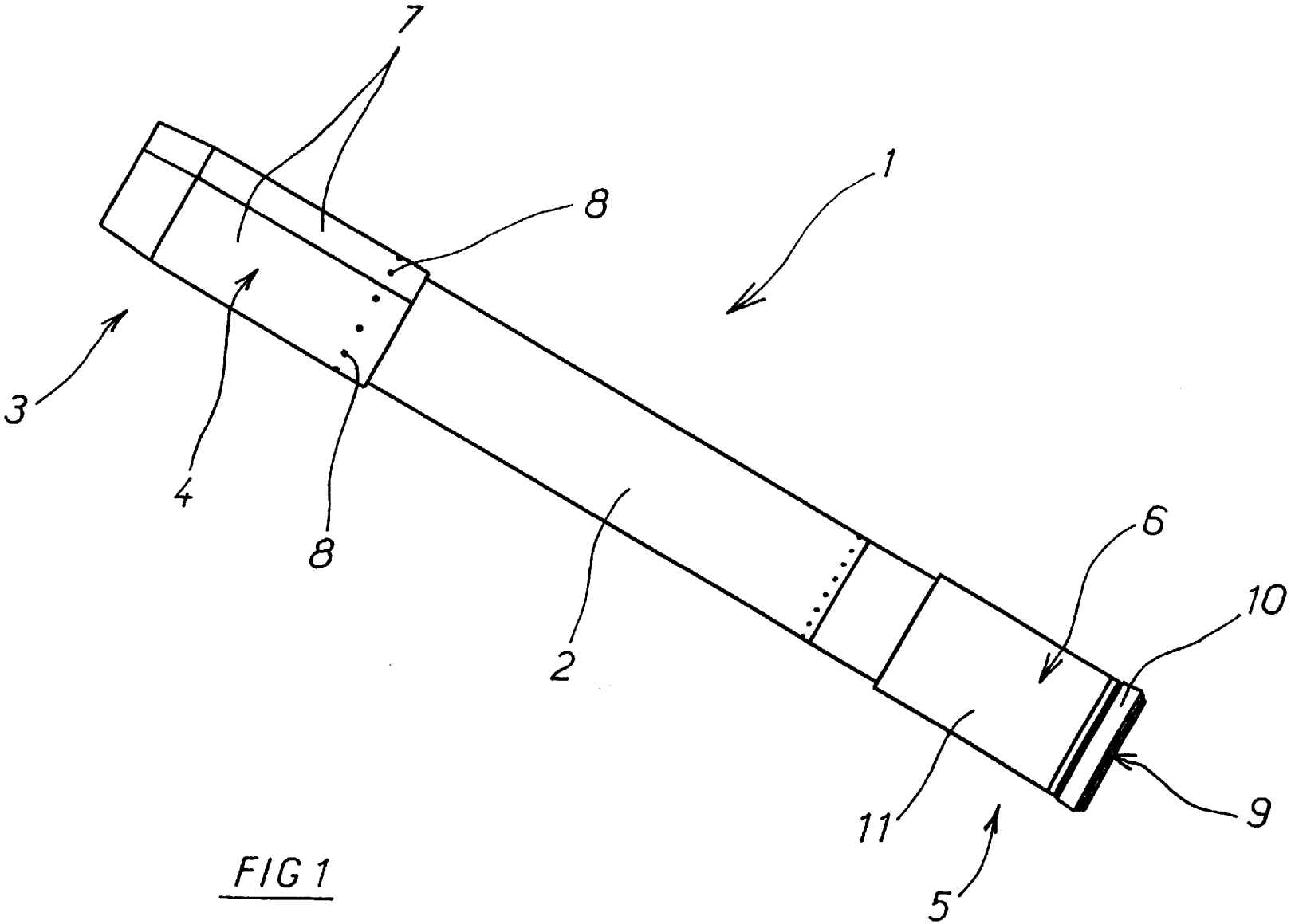
FIG. 1 shows an external view of an artillery projectile according to the invention.

With reference to FIG. 1, a large-calibre field artillery projectile 1, according to the invention, is formed of a body 2 carrying in a front part 3 a first, front ejectable sabot 4 and in a rear part 5 a second, or rear ejectable sabot 6.

Front sabot 4 is formed of several segments 7, in this example there are three of them, connected to projectile body 2 by radial pins 8. Each segment 7 can be made of an organic substance, for example of the loaded thermoplastic type.

Rear sabot 6 firstly comprises a thrusting part 9 carrying a sliding band around its periphery 10, and secondly a tubular part 11 covering rear part 5 of the projectile body. Tubular part 11 is made integral with thrusting part 9, for example by bonding. Thrusting part 9, made in steel, is designed to accommodate the propellant gases during the gun phase. Tubular part 11 is made of a thermoplastic.

Front sabots 4 and rear sabots 6 are intended to ensure the guidance of the projectile inside the barrel of a gun (not shown).

This type of structure composed of a front and rear guidance that are relatively distanced from one another is particularly well suited to a projectile of substantial length.

Body 2 is thus sub-calibred with respect to the inner diameter of the bore of the gun barrel, which enables the starting velocity to be increased whilst reducing the aerodynamic drag coefficient of the projectile and thus increasing its range.

Body 2 is intended to ensure the transportation of a payload (not shown), which can be composed of sub-munitions intended to be scattered over a target.

To stabilise the projectile on its trajectory, either spin-stabilisation or fin-stabilisation is used.

Field artillery projectiles are usually fired from large-calibre gun barrels, of the 155 mm type, which have inner rifling intended to impart a considerable spin rate to the projectiles so as to stabilise them during their trajectory. These projectiles are called spin-stabilised projectiles.

The artillery projectile according to the invention is designed to carry a large payload, for example several sub-munitions. This on-board load thus requires a long projectile length thereby preventing the stabilisation of the projectile by gyroscopic effect.

The stabilisation of projectile 1 according to the invention is carried out by means of a tail piece 12 (see FIG. 2) placed at the rear part 5 of body 2 and which is deployed upon exiting the gun barrel.

Sliding band 10, of the type described in patent FR-A-2, 606,869, is intended to mesh with the rifling in the gun barrel and to slide on thrusting part 9 so as to reduce the spin rate of the projectile. Thus, upon exiting the gun barrel, the projectile is only subjected to a low spin rate of around 10 revs/sec.

This slow projectile spin rate advantageously allows the tailpiece to deploy in the right conditions upon exiting the barrel, being subjected only to weak stresses, which do not disturb the projectile's stability.

Stabilising tailpiece 12 is formed of four flat fins made of steel having a very high elastic limit. Each fin is hinged to its root and can be locked in its deployed position.

Figure 2:
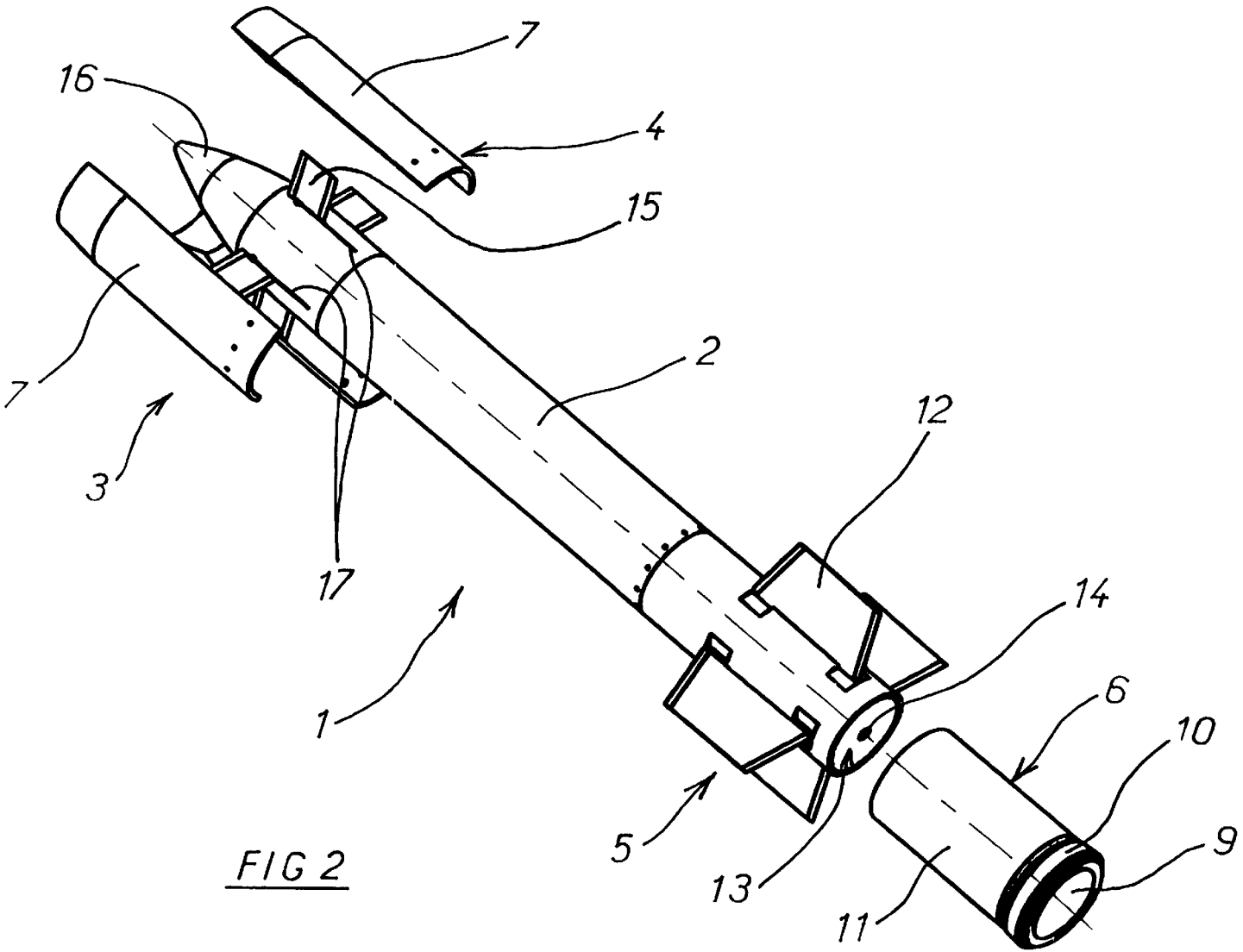
FIG. 2 shows the artillery projectile according to the invention with the front and rear sabots having been ejected.

The fins of tail piece 12, shown in their deployed position in FIG. 2, were originally wound around the exterior of rear part 5 of body 2 of the projectile and held in position by tubular part 11 of sabot 6.

Rear sabot 6 and body 2 are made integral with one another by the fins of tail piece 12 which press on the inner surface of tubular part 11 of sabot 6. The fins are retained in their wound position by sabot 6.

Body 2 incorporates at its rear part 5 a supplementary booster 13 intended to increase the projectile's range.

Supplementary booster 13 is formed, in a conventional manner, of a high strength steel body incorporating a propellant gas ejection nozzle 14. It incorporates a propellant charge formed of a block of solid propellant of the double base type.

Upon exiting the gun barrel, supplementary booster 13 is ignited, for example by diverting the propellant gases through an axial opening arranged in thrust plate 9. The high-pressure gases produced by the combustion of the propellant charge are ejected by ejection nozzle 14 and generate an axial thrust. This generation of propellant gases ensures the separation and thereafter the ejection, to the rear of the projectile of rear sabot 6.

In FIG. 2, segments 7 of front sabot 4 occupy a position distanced from body 2. The ejection of the front sabot is carried out upon exiting the barrel, after breaking pins 8, as will be explained hereafter, thanks to the aerodynamic forces to which the front of the sabot is subjected and which allow segments 7 to be pushed away.

Front part 3 of projectile body 2 incorporates deployable guiding ailerons 15, of which there are four in this example. These ailerons can be deployed through slits 17 made in body 2. They are deployed during the trajectory at a given moment as will be explained hereafter. They are intended to ensure the guidance of the projectile.

Front part 3 also incorporates a ballistic nose cone 16 containing a set of guidance and piloting equipment (not shown), notably roll, yaw and pitch gyros, a GPS device with its antennas, a module to actuate the ailerons with its reduction servo-motors, as well as a power source and command unit.

Figure 3:
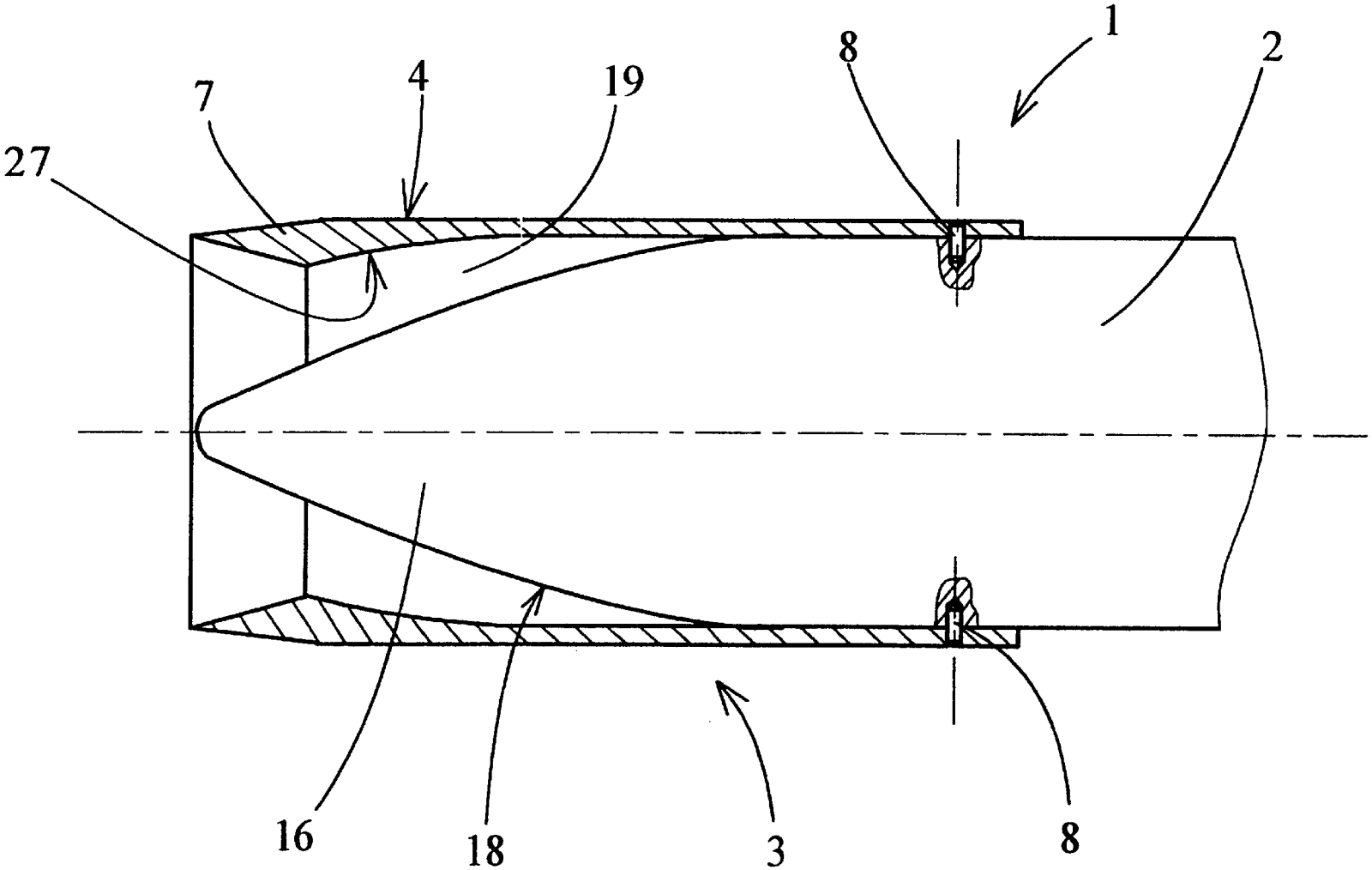
FIG. 3 shows a partial section of the front part of the projectile according to the invention.

FIG. 3 shows a partial section of front part 3 of projectile 1.

Front part 3 of projectile 1 carries sabot 4, which is composed of the three segments 7 made integral with body 2 by radial pins 8.

Segments 7 of the sabot have an inner profile 17, which matches the external profile 18 of nose cone 16. When sabot 4 is connected to body 2 by pins 8, as shown in FIG. 3, there remains an axial clearance between the two profiles 27 and 18, segments 7 of the sabot being in a forward position with respect to body 2.

When the propellant charge is ignited inside the gun barrel, the pressure generated by the propellant charge combustion gases is exerted on the thrusting plate 9 of rear sabot 6 and pushes projectile 1 inside the gun barrel. The friction forces between front sabot 4 and the rifling of the gun barrel act against the substantial longitudinal acceleration of the projectile and a shearing force is thus created at pins 8, causing them to break. Segments 7 of sabot 4 break away from body 2 and the front sabot thereafter recoils with respect to the body until coming to abut against profile 27 of the sabot on the external profile 18 of nose cone 16 and eliminating the clearance 19.

Figure 4:
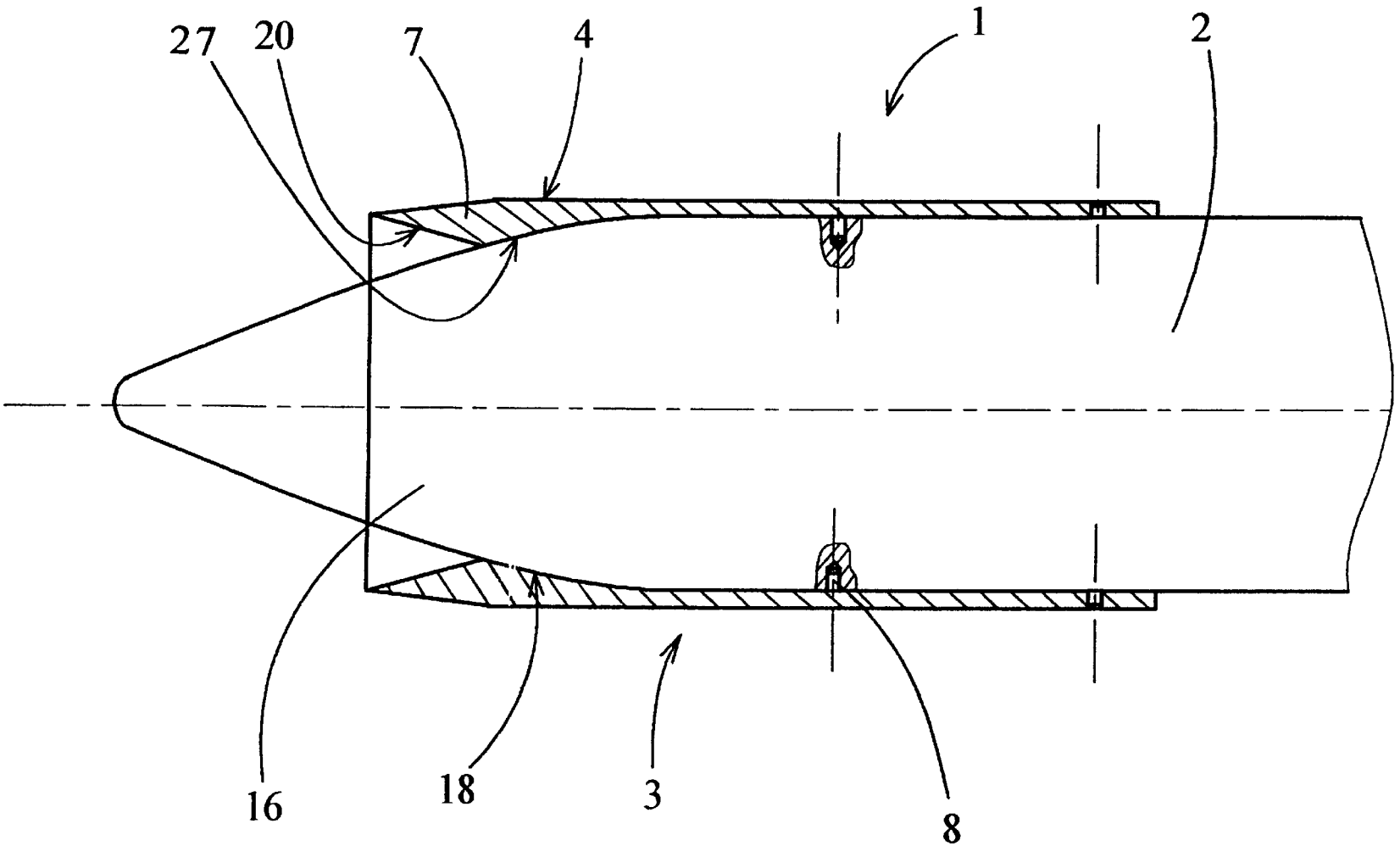
FIG. 4 shows a partial section of the front part of the projectile after separation of the sabot from the body.

FIG. 4 shows this phase after the relative recoil of segments 7 of the front sabot with respect to body 2, when the two profiles 27 and 18 are in contact with each other. In this configuration, segments 7 of sabot 4 are separated from body 2 of the projectile, the pins having broken. Upon exiting the gun barrel, the aerodynamic pressure exerted on a front conical support 20 of sabot 4 causes first the opening and then the ejection of segments 7.

The different stages of operation of the artillery projectile according to the invention are as follows;

Internal ballistic phase inside the gun barrel:
- ignition of the propellant charge,
- breaking of connecting pins 8,
- relative recoil of segments 7 of front sabot 4 with respect to body 2.

Ballistic flight phase, immediately after exiting the gun barrel:
- ejection of segments 7 of front sabot 4,
- priming of supplementary booster 13,
- ejection of rear sabot 6,
- opening of stabilising fins 12.

Piloted flight phase, substantially timed from the apogee of the trajectory:
- opening of the piloting ailerons 15 driven by the servo-motors,
- guidance-piloting of the projectile towards the target.

Piloting ailerons 15 are advantageously opened only after reaching the apogee of the trajectory so as to reduce the aerodynamic drag and ensure sufficient stability during the ballistic flight.

Thus, the projectile according to the invention, being of the sub-calibred type fitted with a supplementary booster, allows a substantial payload, of around 30 kg, to be carried on-board, and ensures a substantial firing range of around 60 to 80 km.

Naturally, other variants can be envisaged without departing from the scope of the invention.

Figure 5:
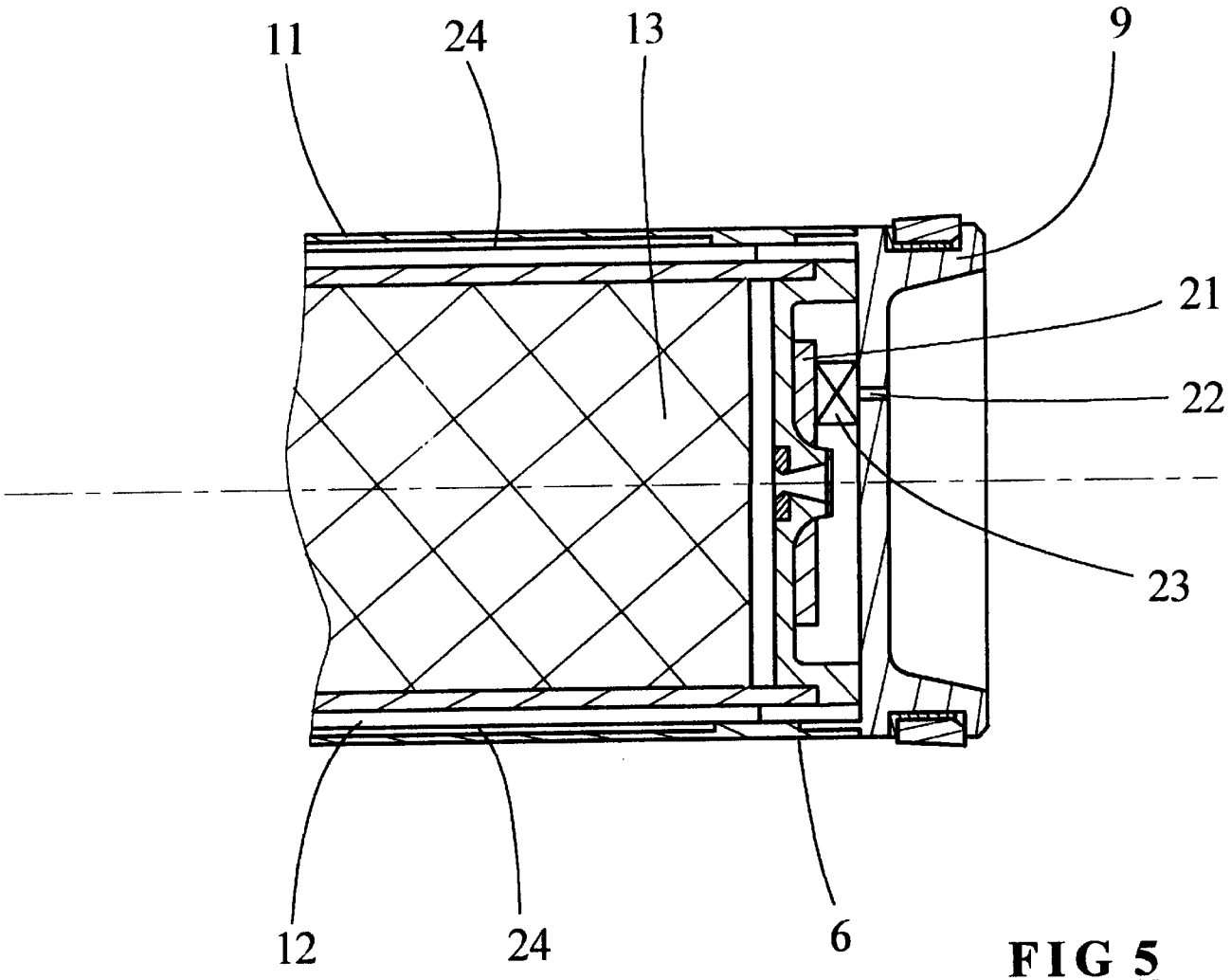
FIG. 5 shows a partial cross-section of the rear part of the projectile, rear sabot and tubular casing.

For example, in the event that the supplementary booster be ignited only during the trajectory, for example by means of an electrical primer, the ejection of the rear sabot can be carried out by means of a pyrotechnic charge 21 placed between booster 13 and thrusting plate 9 of rear sabot 6 and ignited immediately upon exiting the gun barrel (see FIG. 5). This pyrotechnic charge 21 can by ignited by diverting the propellant gases, for example through an axial opening 22 arranged in thrusting plate 9, a pyrotechnic delay 23 ensuring the ejection of rear sabot 6 upon exiting the gun barrel.

A pyrotechnic charge of this type can, naturally, complete the ejection means for rear sabot 6 via booster 13 described in FIG. 2. In fact, as the pressure build-up in the booster is not instant, a rapid separation of the sabot by means of a pyrotechnic charge would present the advantage of freeing the stabilising fins immediately upon exiting the gun barrel, thus improving the stabilisation of the projectile.

An embrittlement of tubular part 11, by means of longitudinal cuts 24 in its wall (shown in FIG. 5) can also be envisaged so as to improve its aerodynamic braking immediately upon exiting the gun barrel. Thus, the pressure generated by the ejection pyrotechnic charge 21 and/or booster 13 would cause tubular part 11 to fracture along the zones of embrittlement 24. Tubular part 11 would then open up in a flower-shape, thus increasing its aerodynamic braking.

What is claimed is:

1. A projectile to be fired from a gun, comprising:

a sub-calibred body with front and rear parts;

fins fitted to the rear part for deployment to stabilize the body;

a rear ejectable guiding sabot on the rear part;

a sliding drive band on the rear sabot, said band for reducing spin rate of the body; and a front ejectable guiding sabot comprising at least two segments connected to the front part by a temporary connecting means, the connecting means having at least one pin shearable upon firing whereby recoil of the front sabot with respect to the body causes shearing of the pin.

2. A projectile according to claim 1, wherein said rear sabot holds said deployable stabilising fins in place, the fins being deployable when the rear sabot exits a gun barrel from which the projectile is fired.

3. A projectile according to claim 2, wherein said rear sabot comprises a thrusting part which receives the sliding drive band and a tubular part covering the rear part of said body thereby keeping said stabilising fins in their folded-back position.

4. A projectile according to claim 3, wherein said tubular part of said rear sabot has longitudinal zones of embrittlement for fracture during the ejection of said rear sabot for increasing aerodynamic drag.

5. A projectile according to 1, wherein said front sabot possesses an inner profile which matches an external profile of said front part of said body and wherein there is an axial clearance between the inner profile of said sabot and the external profile of the front of said body to allow the relative recoil of said sabot with respect to said body during its longitudinal acceleration in a gun barrel.

6. A projectile to be fired from a gun, comprising:

a sub-calibred body with front and rear parts;

fins fitted to the rear part, for deployment to stabilize the body;

a rear ejectable guiding sabot on the rear part;

a sliding drive band on the rear sabot, said band for reducing spin rate of the body;

a front ejectable guiding sabot comprising at least two segments connected to the front part by a temporary connecting means, the connecting means having at least one pin shearable upon firing whereby recoil of the front sabot with respect to the body causes shearing of the pin; and deployable pivoting ailerons in the front part.

7. A projectile according to claim 6, further comprising a rear booster in the rear part.

8. A projectile according to claim 7, wherein said booster is capable of generating pressure to eject the rear sabot upon exiting a gun barrel.

9. A projectile according to claim 7, wherein a pyrotechnic charge for ejecting the rear sabot is located between said thrusting part of said rear sabot and the rear part of said projectile body.

* * * * *